United States Patent [19]

Funakawa et al.

[11] Patent Number: 4,922,584

[45] Date of Patent: May 8, 1990

[54] SLIDE FASTENER

[75] Inventors: Shigeru Funakawa, Toyama; Mitsuo Horikawa, Kurobe, both of Japan

[73] Assignee: Yoshida Kogyo K. K., Tokyo, Japan

[21] Appl. No.: 330,693

[22] Filed: Mar. 30, 1989

[30] Foreign Application Priority Data

Apr. 4, 1988 [JP] Japan ..... 63-45499[U]

[51] Int. Cl.[5] ..... A44B 19/40

[52] U.S. Cl. ..... 24/381; 24/394; 24/413

[58] Field of Search ..... 24/381, 413, 394; 428/212

[56] References Cited

U.S. PATENT DOCUMENTS

| | | | |
|---|---|---|---|
| 2,903,775 | 9/1959 | Johns . | |
| 3,200,462 | 8/1965 | McMurray . | |
| 3,224,061 | 12/1965 | Taylor | 24/394 |
| 3,925,858 | 12/1975 | Thaeler | 24/381 |
| 4,100,656 | 7/1978 | Moertel | 24/413 |
| 4,156,303 | 5/1979 | McGuire | 24/413 |
| 4,186,466 | 2/1980 | Schleifstein | 24/381 |
| 4,333,903 | 6/1982 | Yoshida et al. | 24/394 |

FOREIGN PATENT DOCUMENTS

| | | |
|---|---|---|
| 1479519 | 3/1967 | France . |
| 52-8867 | 3/1977 | Japan . |
| 1507915 | 4/1975 | United Kingdom . |
| 2139695 | 11/1984 | United Kingdom . |

*Primary Examiner*—Victor N. Sakran

*Attorney, Agent, or Firm*—Hill, Van Santen, Steadman & Simpson

[57] ABSTRACT

A slide fastener comprising a pair of stringer tapes which are separable into identical halves by means of a pin-and-box separator, a reinforcing strip attached to an end of each of the stringer tapes and an adhesive film fusible to bond the strip to the tape. Both of the stringer tape and the reinforcing strip are made of the same type of fibrous materials, while the adhesive film is a modified polyester or a copolymeric polyamide depending upon the type of materials chosen for the stringer tape and the strip.

4 Claims, 1 Drawing Sheet

SLIDE FASTENER

BACKGROUND OF THE INVENTION

1. Field of the Invention

This invention relates to slide fasteners and more particularly to such a slide fastener which is suitable for dyeing simultaneously with a garment article to which the fastener is attached.

2. Prior Art

Amongst a variety of slide fasteners is known one which is fully separable into identical halves by means of a separator including a pin and a socket member. To facilitate separation of the slide fastener, there are provided reinforcing strips at both upper and lower end portions of the fastener tapes, the reinforcing strips being secured usually by fusion of an adhesive film to the respective tape ends to render the latter ends rigid enough. The reinforcing strips in common use are made predominantly of nylon and initially dyed to match the color of a given slide fastener tape. Such reinforcing strips are attached by an adhesive film of mostly commonly polyester with heat and pressure to the respective end portions of the fastener tape.

In light of the recent trend of the garment industry which demands shortened delivery terms, small lot production, reduced inventories and a minimum risk of speculative production, it has been a common practice to dye garment articles in their final product form rather than pre-dyeing the starting fabric materials. To cope with this trend, it has also been proposed to dye slide fasteners of the separable type simultaneously with the particular garment article to which the fastener is attached. However, difficulties were encountered in achieving homogeneity and regularity in the hues between the fastener stringer tapes and the reinforcing strips attached thereto. Another drawback was found in separation or peel-off of the adhesive film used to bond the reinforcing strip to the tape.

SUMMARY OF THE INVENTION

With the foregoing drawbacks of the prior art in view, the present invention seeks to provide a slide fastener having reinforcing end strips which can be dyed homogeneously and simultaneously with the dyeing of a garment article to which the fastener is attached.

The invention further seeks to provide a separable type of slide fastener having reinforcing end strips which can be retained in place against separation from the fastener even after being dyed.

Therefore, by the practice of the invention it is made possible to eliminate the necessity of over-inventories and the risk of speculative production, to enhance the rate of slide fastener yields, and to dye the slide fastener simultaneously with an ultimate garment article.

The above objects of the invention can be achieved by the selection of particular materials for fastener stringer tapes, reinforcing strips and adhesive films, respectively, and the selection of particular dyes and dyeing conditions whereby the fastener tape and the reinforcing strip can be dyed homogeneously and can be firmly bonded together.

According to one aspect of the invention, there is provided a slide fastener comprising a pair of stringer tapes each carrying thereon a row of coupling elements, said stringer tapes being made of undyed polyester fiber, a reinforcing strip attached to an end of each of said tapes, said strip being made of undyed polyester fiber and an adhesive film adapted to bond said reinforcing strip to said tape end, said film being made of a modified polyester melting in the range of 160°-200° C., preferably 165°-175° C.

According to another aspect of the invention, there is provided a slide fastener comprising a pair of stringer tapes and a reinforcing strip, both of said tape and said strip being made of undyed nylon fibers, and an adhesive film made of a copolymeric polyamide melting above 140° C. and adapted to bond said reinforcing strip to an end of each of said tapes.

According to a further aspect of the invention, there is provided a slide fastener comprising a pair of stringer tapes and a reinforcing strip, both of said tapes and said strip being made of undyed cotton fibers and an adhesive film made of a copolymeric polyamide melting above 140° C. and adapted to bond said reinforcing strip to an end of each of said tapes.

The invention will be described in greater detail with reference to certain preferred embodiments illustrated in the accompanying drawings.

DETAILED DESCRIPTION

Figure 1:
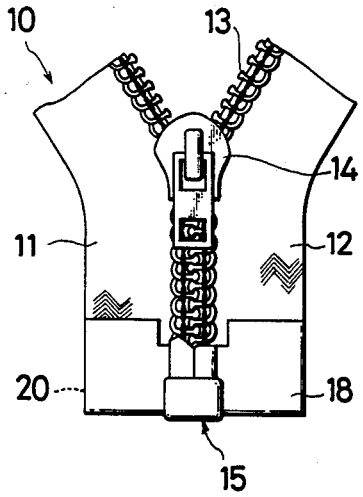
FIG. 1 is a fragmentary plan view of a separable type of slide fastener to which the principles of the invention are applied.

Referring now to the drawings and FIG. 1 in particular, there is shown a separable type of slide fastener 10 which comprises a pair of stringer tapes 11, 12 each carrying along its inner longitudinal edge a row of coupling elements 13 which are illustrated to be in the form of a continuous helical coil. Two oppositely disposed rows of coupling elements 13 are taken into and out of engagement with each other by a slider 14 in a manner well known in the art.

Figure 2:
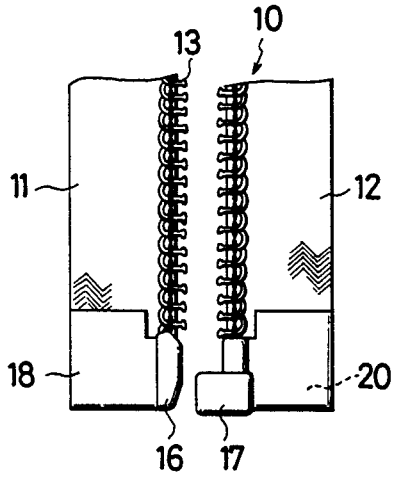
FIG. 2 is a plan view of the slide fastener shown in separated disposition.
Figure 3:
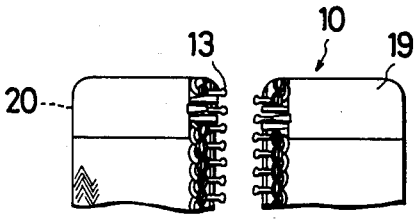
FIG. 3 is a plan view of the upper end portions of the slide fastener.

A separator 15 comprises a pin member 16 and a box member 17, the pin member 16 having secured to the inner edge of one tape 11 at the lower end thereof and the box member 17 being secured to the inner edge of the other tape 12 at the lower end thereof. The pin member 16 is releasably engageable in a slot in the box member 17 and is manipulated to join together as shown in FIG. 1 and separate as shown in FIG. 2 the identical halves of the fastener 10.

A reinforcing strip 18 is attached to a lower end portion of each of the paired tapes 11, 12 to provide reinforced physical strength at that end portion. A similar reinforcing strip 19 is applied for the same purpose to an upper end portion of each of the tapes 11, 12.

An adhesive film 20 is interposed between each tape 11, (12) and the reinforcing strip 18, (19) and adapted to bond the latter to the former with heat and pressure in a manner well known in the art.

The slide fastener 10 thus constructed appears no more different from any ordinary separable slide fastener except that the fastener 10 according to the invention is undyed.

Typical materials for slide fastener tapes 11, 12 currently used in consideration of the type of fabric materials for various garment articles include nylon 6 or 66, polyester, cotton and similar fibrous materials which are woven or knitted into tapes of standard sizes.

Extensive research and experimental work has been conducted in an effort to reach a specific material for each of the reinforcing strip 18, (19) and the adhesive film 20 which excels in respect of the adhesiveness between the reinforcing strip and the tape 11, (12) prior to dyeing the separation therebetween subsequent to dyeing and the dye homogeneousness.

It has not been found that certain specific combinations of selected materials for tape 11, (12), reinforcing strip 18, (19) and adhesive film 20, respectively, will provide improved strip-to-tape adhesiveness, homogeneous dye finish, and increased resistance to separation (peel-off) between the strip and the tape after they have been dyed. Preferred examples of such material combinations according to the invention are represented in Inventive Examples 1, 2 and 3 and below which are tabulated along with other comparative combinations in the Table.

INVENTIVE EXAMPLE 1

| | |
|---|---|
| Stringer tape | Polyester |
| Reinforcing strip | Polyester |
| Adhesive film | modified polyester melting at 170° C. |
| Dye | Dispersion type |
| Dyeing conditions | 130° C. for 30–40 minutes |
| Physical qualities | |
| Adhesiveness | excellent |
| Dye homogeneousness | excellent |
| Resistance to peel-off of reinforce strip | excellent |

INVENTIVE EXAMPLE 2

| | |
|---|---|
| Stringer tape | Nylon 6 (or 66) |
| Reinforcing strip | Nylon 6 (or 66) |
| Adhesive film | Copolymeric polyamide, melting at 145° C. |
| Dye | Acidic type |
| Dyeing conditions | 98° C.–100° C. for 30–40 minutes |
| Physical qualities | |
| Adhesiveness | excellent |
| Dye homogeneousness | excellent |
| Resistance to peel-off | excellent |

-continued

| | |
|---|---|
| of reinforce strip | |

INVENTIVE EXAMPLE 3

| | |
|---|---|
| Stringer tape | Cotton |
| Reinforcing strip | Cotton |
| Adhesive film | Copolymeric polyamide, melting at 145° C. |
| Dye | Direct or Reactive type |
| Dyeing conditions | 90° C.–95° C. for 50 minutes for direct type, and 60° C. for 60 minutes for reactive type |
| Physical qualities | |
| Adhesiveness | excellent |
| Dye homogeneousness | excellent |
| Resistance to peel-off of reinforce strip | excellent |

Adhesiveness of the strip 18, (19) to the tape 11, (12) prior to dyeing is considered excellent if the strip is not peeled off under the influence of in excess of 1,000 g/cm pull force.

On evaluation of the results of the quality tests it has now been found that the material of the adhesive film 20 plays an important sole in respect of adhesive strength and when it is the same as or similar to the material of the stringer tape 11, (12) (except for cotton), highly satisfactory adhesion between the strip 18, (19) and the tape 11, (12) can be achieved. It has also been found that better results in respect of homogeneous dye finish can be obtained with the use of similar materials for both the stringer tape (except for nylon 6 or 66) and the reinforcing strip, the adhesive film being not directly associated. In respect of separation or peel-off of the reinforcing strip after being dyed, it is more to the dye bath temperature and the melting point of the adhesive film than to the reinforcing strip that the results are attributed, and it has further been found that the material for the adhesive film is associated with a stringer tape of polyester, but not with stringer tapes of nylon 6 (or 66) and cotton.

Obviously, various modifications and variations of the present invention are possible in the light of the above teaching. It is therefore to be understood that within the scope of the appended claims the invention may be practiced otherwise than as specifically described.

TABLE

| | | Reinforcing tape | | | | | | | | |
|---|---|---|---|---|---|---|---|---|---|---|
| | | Polyester | | | Nylon 6 (or 66) | | | Cotton | | |
| | | Dye | | | | | | | | |
| | | Dispersion type | | | Acidic type | | | | | |
| | | Dyeing Conditions | | | | | | Direct or Reactive type | | |
| | | 130° C. for 40 mins. | | | 98°–100° C. for 30–40 mins. | | | 90°–95° C. for 50 mins. for direct type, and 60° C. for 60 mins. for reactive type | | |
| | | Physical qualities | | | | | | | | |
| Stringer tape | Adhesive film | Adhesiveness | Dye homogeneousness | Peel off | Adhesiveness | Dye homogeneousness | Peel-off | Adhesiveness | Dye homogeneousness | Peel-off |
| Nylon 6 (or 66) | modified polyester melting at 138° C. | o | x | x | x | x | o | x | x | o |
| polyester | | o | o | x | x | x | o | x | x | o |
| cotton | | o | x | x | x | x | o | x | o | o |
| Nylon 6 (or 66) | modified polyester melting at 170° C. | o | x | o | x | x | o | x | x | o |
| polyester | | o | o | o | x | x | o | x | x | o |
| cotton | | o | x | o | x | x | o | x | o | o |
| Nylon 6 (or 66) | copolymeric | x | x | x | o | o | x | o | x | x |
| | | x | o | x | o | x | x | o | x | x |

TABLE-continued

| | | Reinforcing tape | | | | | | | | |
|---|---|---|---|---|---|---|---|---|---|---|
| | | Polyester | | | Nylon 6 (or 66) | | | Cotton | | |
| | | Dye | | | | | | | | |
| | | Dispersion type | | | Acidic type | | | | | |
| | | Dyeing Conditions | | | | | | Direct or Reactive type | | |
| | | 130° C. for 40 mins. | | | 98°-100° C. for 30-40 mins. | | | 90°-95° C. for 50 mins. for direct type, and 60° C. for 60 mins. for reactive type | | |
| | | Physical qualities | | | | | | | | |
| Stringer tape | Adhesive film | Adhe-siveness | Dye homo-geneousness | Peel off | Adhe-siveness | Dye homo-geneousness | Peel-off | Adhe-siveness | Dye homo-geneousness | Peel-off |
| polyester cotton | polyester melting at 130° C. | x | x | x | o | x | x | o | o | x |
| Nylon 6 (or 66) | copoly-meric | x | x | x | o | o | o | o | x | o |
| polyester cotton | polyester melting at 145° C. | x | o | x | o | x | o | o | x | o |
| | | x | x | x | o | x | o | o | o | o |

o: excellent
x: poor

What is claimed is:

1. A selectively dyeable slide fastener comprising a pair of stringer tapes each carrying along its longitudinal edge a row of coupling elements, a reinforcing strip and an adhesive film adapted to bond said reinforcing strip to an end portion of each of said stringer tapes, characterized in that both said stringer tapes and said reinforcing strip are made of undyed polyester fibers that can be dyed with an associated garment so as to indentically match the color thereof and said adhesive film is a modified polyester melting in the range of 160°-200° C.

2. A selectively dyeable slide fastener comprising a pair of stringer tapes each carrying along its longitudinal edge a row of coupling elements, a reinforcing strip and an adhesive film adapted to bond said reinforcing strip to an end portion of each of said stringer tapes, characterized in that both said stringer tapes and said reinforcing strip are made of undyed nylon fibers that can be dyed with an associated germent so as to indentically match the color thereof and said adhesive film is made of a copolymeric polyamide melting above 140° C.

3. A selectively dyeable slide fastener comprising a pair of stringer tapes each carrying along its longitudinal edge a row of coupling elements, a reinforcing strip and an adhesive film adapted to bond said reinforcing strip to an end portion of each of said stringer tapes, characterized in that both said stringer tapes and said reinforcing strip are made of undyed cotton fibers that can be dyed with an associated garment so as to indentically match the color thereof and said adhesive film is made of a copolymeric polyamide melting above 140° C.

4. A selectively dyeable slide fastening comprising a pair of stringer tapes each carrying along its longitudinal edge a row of coupling elements, a reinforcing strip and an adhesive film adapted to bond said reinforcing strip to an end portion of each of said stringer tapes, wherein both said stringer tapes and said reinforcing strips are made of identical undyed fibrous materials that can be dyed with an associated garment so as to identically match the color thereof.

* * * * *